US011400348B2

(12) United States Patent
Lee et al.

(10) Patent No.: US 11,400,348 B2
(45) Date of Patent: Aug. 2, 2022

(54) FACE FOR GOLF DRIVER

(71) Applicants: Chung Hyeon Lee, Daegu (KR); Su Hee Lim, Daegu (KR)

(72) Inventors: Chung Hyeon Lee, Daegu (KR); Su Hee Lim, Daegu (KR)

( * ) Notice: Subject to any disclaimer, the term of this patent is extended or adjusted under 35 U.S.C. 154(b) by 0 days.

(21) Appl. No.: 17/167,146

(22) Filed: Feb. 4, 2021

(65) Prior Publication Data

US 2021/0236888 A1 Aug. 5, 2021

(30) Foreign Application Priority Data

Feb. 4, 2020 (KR) ..... 10-2020-0013205
Nov. 24, 2020 (KR) ..... 10-2020-0158721

(51) Int. Cl.
*A63B 53/04* (2015.01)

(52) U.S. Cl.
CPC ..... *A63B 53/0445* (2020.08); *A63B 53/0466* (2013.01)

(58) Field of Classification Search
CPC ..... A63B 53/0416; A63B 53/042; A63B 53/0445; A63B 53/0458; A63B 53/062; A63B 53/066
USPC ..... 473/324–350
See application file for complete search history.

(56) References Cited

U.S. PATENT DOCUMENTS 1,211,708 A * 1/1917 Hudson ..... A63B 53/04 473/330
3,869,126 A * 3/1975 Thompson ..... A63B 53/0466 473/331
4,471,961 A * 9/1984 Masghati ..... A63B 53/0466 473/330
4,508,349 A * 4/1985 Gebauer ..... A63B 53/04 473/330
5,098,103 A * 3/1992 MacKeil ..... A63B 53/04 473/330
6,093,115 A * 7/2000 Murtland ..... A63B 53/0466 473/330
6,139,445 A * 10/2000 Werner ..... A63B 53/047 473/330
6,183,379 B1 * 2/2001 Kim ..... A63B 53/0487 473/325
6,454,664 B1 * 9/2002 Long ..... A63B 60/00 473/330
7,066,833 B2 * 6/2006 Yamamoto ..... A63B 53/04 473/330
7,641,570 B2 * 1/2010 Yokota ..... A63B 53/0466 473/331
8,425,341 B2 * 4/2013 Takechi ..... A63B 53/0466 473/242
10,835,787 B1 * 11/2020 Evans ..... A63B 53/0466

* cited by examiner

*Primary Examiner* — Alvin A Hunter
(74) *Attorney, Agent, or Firm* — Hauptman Ham, LLP

(57) ABSTRACT

The present disclosure relates to a face for a golf driver including a head for hitting a ball and, a sweet spot point that is a center position of a roll, which is formed in a round shape from the top to the bottom in the front of a head body constituting the head, and a bulge, which is formed in a round shape to the left and right sides thereof, for hitting the ball, and a sweet spot area, which is a specific portion around the sweet spot point, the face include: a sweet spot plane obtained by flattening the sweet spot area of the face; and toe planes and heel planes maintaining roll and bulge lines, and formed in multiple stages in toe and heel areas on the left and right sides of the sweet spot area.

2 Claims, 7 Drawing Sheets

FACE FOR GOLF DRIVER

CROSS-REFERENCE TO RELATED APPLICATION

The present application claims priority based on Korean Patent Application No. 10-2020-0013205, filed on Feb. 4, 2020 and Korean Patent Application No. 10-2020-0158721, filed on Nov. 24, 2020, in the Korean Intellectual Property Office, which are incorporated herein in their entireties by reference.

BACKGROUND OF THE INVENTION

1. Field of the Invention

The present disclosure relates to a face of a golf driver and, more specifically, to a face of a driver, which is capable of increasing the probability of correctly hitting the ball on a sweet spot and repulsive force to increase the driving distance of the ball and, even if the ball is hit on the area other than the sweet spot, improving directivity thereof to prevent extreme hooks or slices, thereby preventing the loss of balls, getting a stable score, and enhancing the sense of hitting.

2. Description of the Prior Art

In order to play golf, the first club used in a tee box is a driver, and conventionally, various types of drivers have been developed and used. Typical examples thereof will be described below with reference to patent documents.

Patent Document 1 is configured to include a body and a striking member disposed on the front surface of the body and striking a golf ball, wherein the striking member is made of a synthetic resin material that is more flexible than the body, and wherein uneven portions are formed on the front surface of a body of the head and on the rear surface of the striking member so as to engage with each other.

Patent Document 2 relates to a driver head formed by forging, which includes: a face provided in the front and having a face surface for hitting a golf ball; a hosel coupled to a shaft having a handle capable of being gripped by a player on the upper side; a crown and a sole extending backwards from the face to form upper and lower portions; and a heel and a toe disposed between the crown and the sole, respectively, on the rear side of the face, wherein the face and the hosel are integrally formed by forging in order to obtain a lower center of gravity of the head by distributing the extra weight to the rear part of the head by putting a heated raw material between a forging upper mold and a forging lower mold of a press to be lightened, wherein the lower end of the hosel is formed to be convex toward the rear and lower portion of the face at the rear of the face, and wherein there is no portion in which the edge of the face surface extends backwards in the vicinity of the hosel.

SUMMARY OF THE INVENTION

When hitting the ball using the driver as described above, hitting a sweet spot makes it possible to maximize reaction force, increase the driving distance, maintain a correct direction, and reduce shock and vibration, thereby preventing damage to the club, prolonging the lifespan thereof, alleviating a physical burden from the users, and enhancing the sense of hitting.

However, it is difficult to accurately hit the sweet spot when actually hitting the ball, and the failure of clean shot causes the ball to be hit on the top or bottom side of the face, including the heel and toe areas of the face, which makes it difficult to maintain consistent directivity so that hooks and slices easily occur, so that a top ball and a flying ball lead to loss of the driving distance, which affects the second shot and the third shot, thus making it difficult for a player to get a good score.

In particular, it is more difficult for seniors and female golfers to hit the sweet spot because they do not have power and speed, so that the ball is hit around the sweet spot, which makes it difficult to guarantee straightness and leads to distance loss.

When a ball is hit by a bulge formed in a round shape in the left and right direction of the face and a roll formed in a round shape in the up and down direction thereof, the ball is always compensated for to be directed toward a target by a gear effect. However, if considerable power and head speed are not provided in the actual hitting process, the gear effect is unable to be obtained, so it is impossible to guarantee clean shot and straightness.

Since the face of the driver to which the prior art is applied has smooth surfaces in a mirror type both in the sweet spot and in the bulge area around the sweet spot, the ball tends to slide on the surfaces when hitting the same, thereby frequently resulting in the ball being directed in wrong directions, which are not intended.

For this reason, if the player fails to hit a clean shot, slices or hooks are more severe. Thus, if the ball goes into the penalty area, instead of landing on the fairway or rough, due to the slices or hooks, the player may experience psychological instability at the beginning from the tee shot, which may bring about many problems such as a bad influence on the whole round.

The present disclosure has been made in order to solve the above problems, and the present disclosure provides a face 110 for a golf driver including a head 101 for hitting a ball, a shaft 103 coupled to the head 101, a grip 105 coupled to the shaft 103 and enabling a player to hold and swing a club, a sweet spot point 113 that is a center position of a roll, which is formed in a round shape from the top to the bottom in the front of a head body 108 constituting the head 101, and a bulge, which is formed in a round shape to the left and right sides thereof, for hitting the ball, and a sweet spot area 115, which is a specific portion around the sweet spot point 113, the face including: a sweet spot plane 116 obtained by flattening the sweet spot area 115 of the face 110; and toe planes 117 and heel planes 118 maintaining roll and bulge lines, and formed in multiple stages in toe and heel areas on the left and right sides of the sweet spot area 115. The present disclosure is configured to increase the probability of hitting the ball on the sweet spot area regardless of the golfer's swing stance and trajectory thereof by the sweet spot plane formed in the center of the head face of the driver and the toe and heel planes formed on both sides thereof, improve straightness and driving distance, and compensate for the ball to be directed toward the center through a clear gear effect even if the ball is hit on the heel and toe areas, thereby attaining the objective of preventing terrible hooks and slices.

The present disclosure configures the sweet spot area of the face of the head constituting the driver in a flat structure and configures the bulge and roll areas around the sweet spot to have planes in multiple stages, thereby providing the effect of increasing the driving distance while ensuring straightness (direction) by compensation according to the gear effect if the ball is accurately hit on the sweet spot point or if the ball is hit on the bulge or roll area.

The sweet spot area of the face is flattened to ensure straightness and driving distance, and the surfaces of the planes formed in multiple stages in the bulge and roll areas around the sweet spot area further have a friction means such as finely knurled portions, friction protrusions, and the like to increase the friction with the ball so that when the ball is hit, the ball is able to be normally compensated for by the gear effect of directing the ball toward the target without slipping, thereby providing various effects such as relieving a burden from the golfers who use the driver and the like.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF THE EXEMPLARY EMBODIMENTS

Hereinafter, a preferred configuration and operation of the present disclosure for attaining the above objectives will be described with reference to the accompanying drawings.

Figure 1:
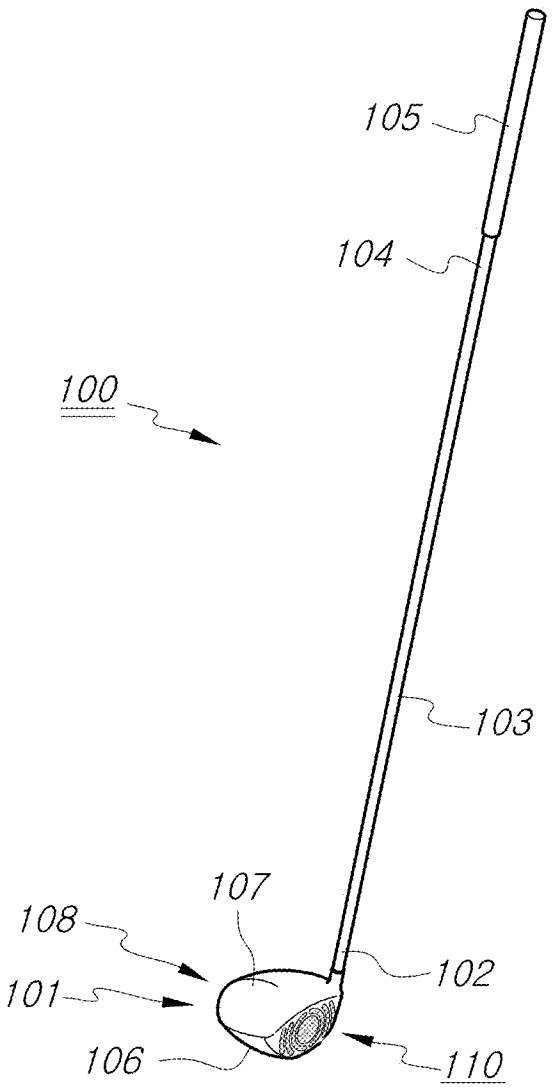
FIG. 1 is an overall perspective view illustrating a golf driver club for description of the present disclosure.
Figure 2:
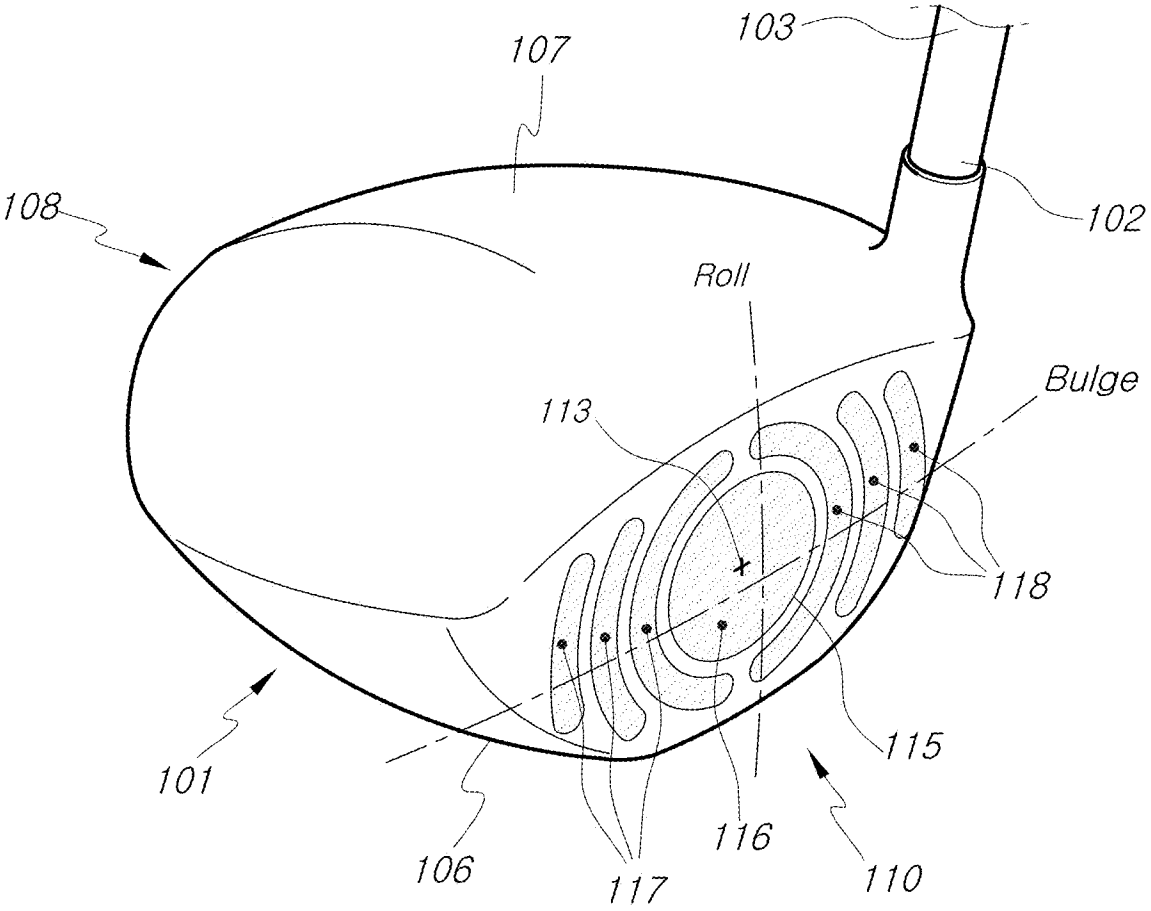
FIG. 2 is a perspective view partially illustrating a face of a golf driver to which the technology of the present disclosure is applied.
Figure 3:
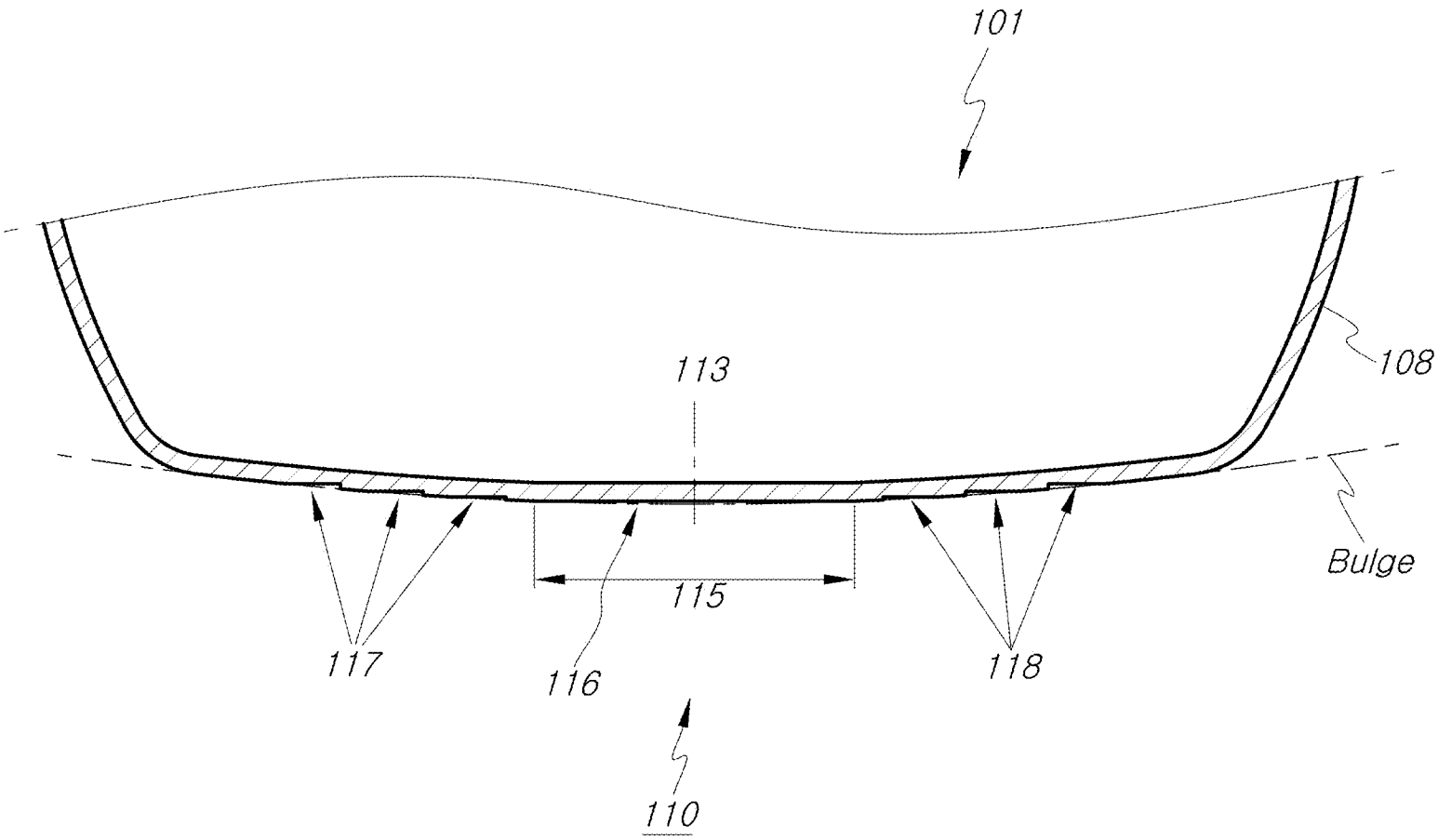
FIG. 3 is a cross-sectional view partially illustrating a face of a golf driver to which the technology of the present disclosure is applied.
Figure 4:
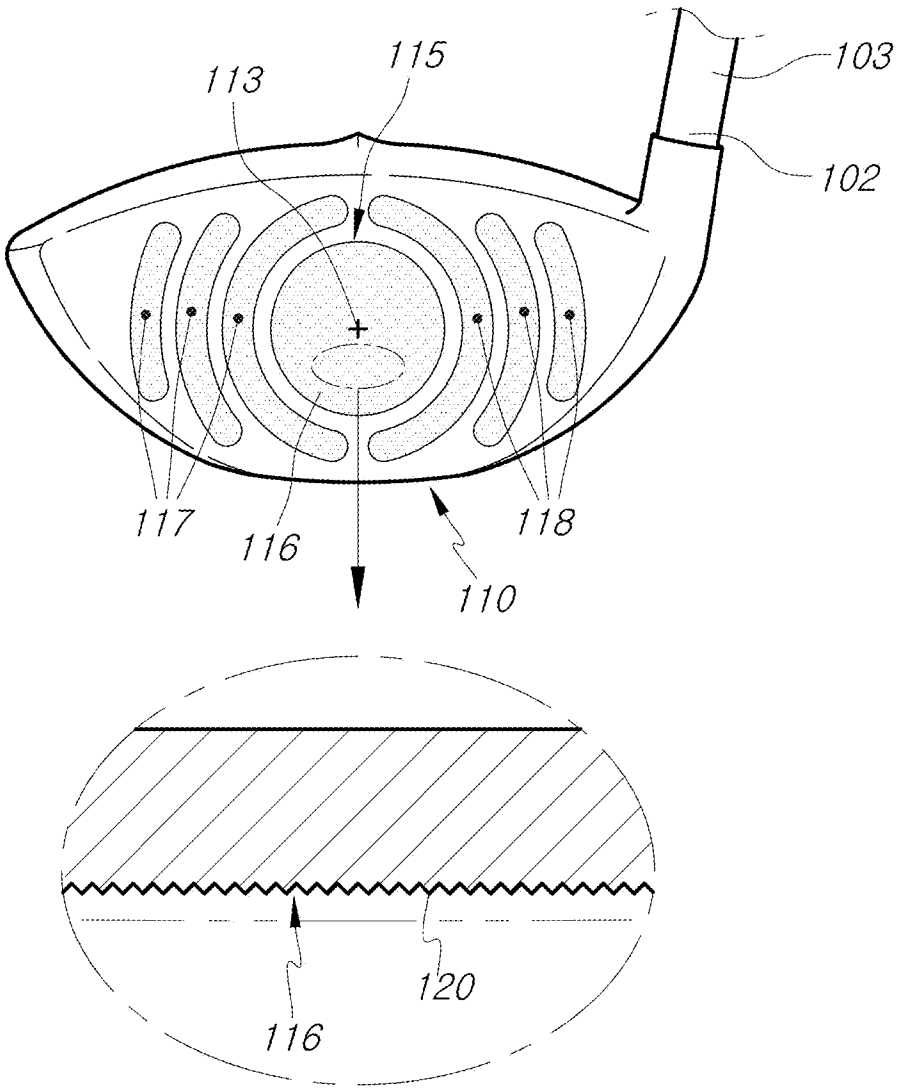
FIG. 4 is a front view and an enlarged view partially illustrating a face of a golf driver to which the technology of the present disclosure is applied.
Figure 5:
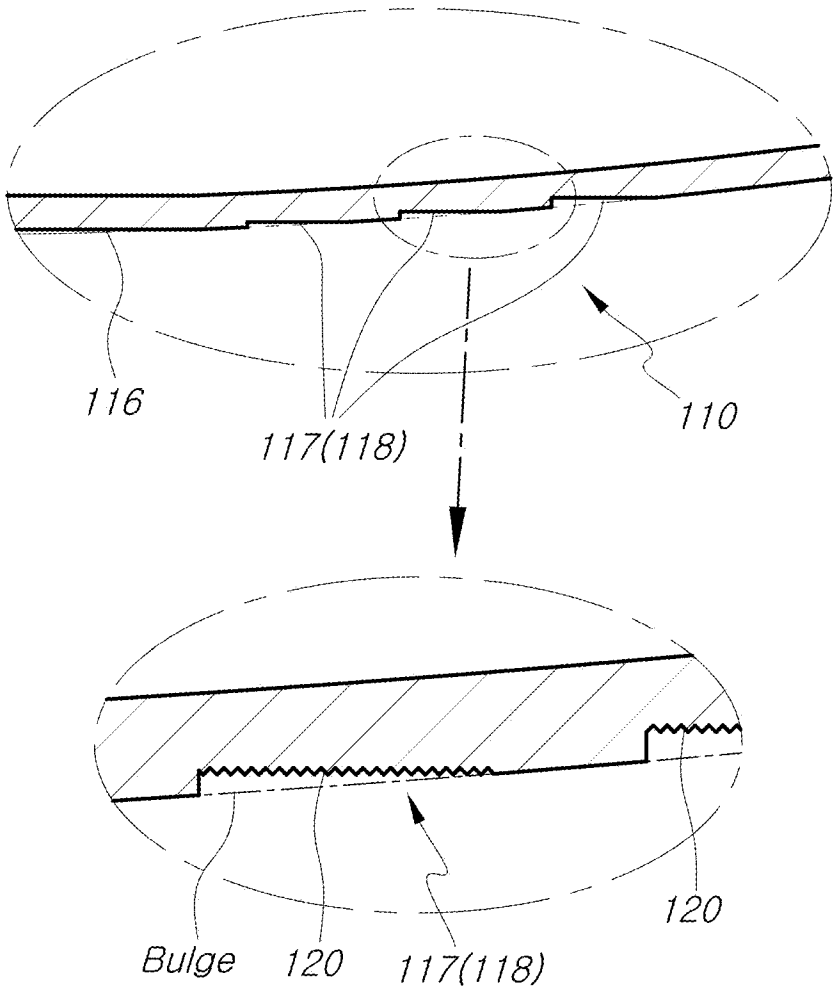
FIG. 5 is a cross-sectional view partially illustrating a bulge area of a face of a golf driver to which the technology of the present disclosure is applied.
Figure 6:
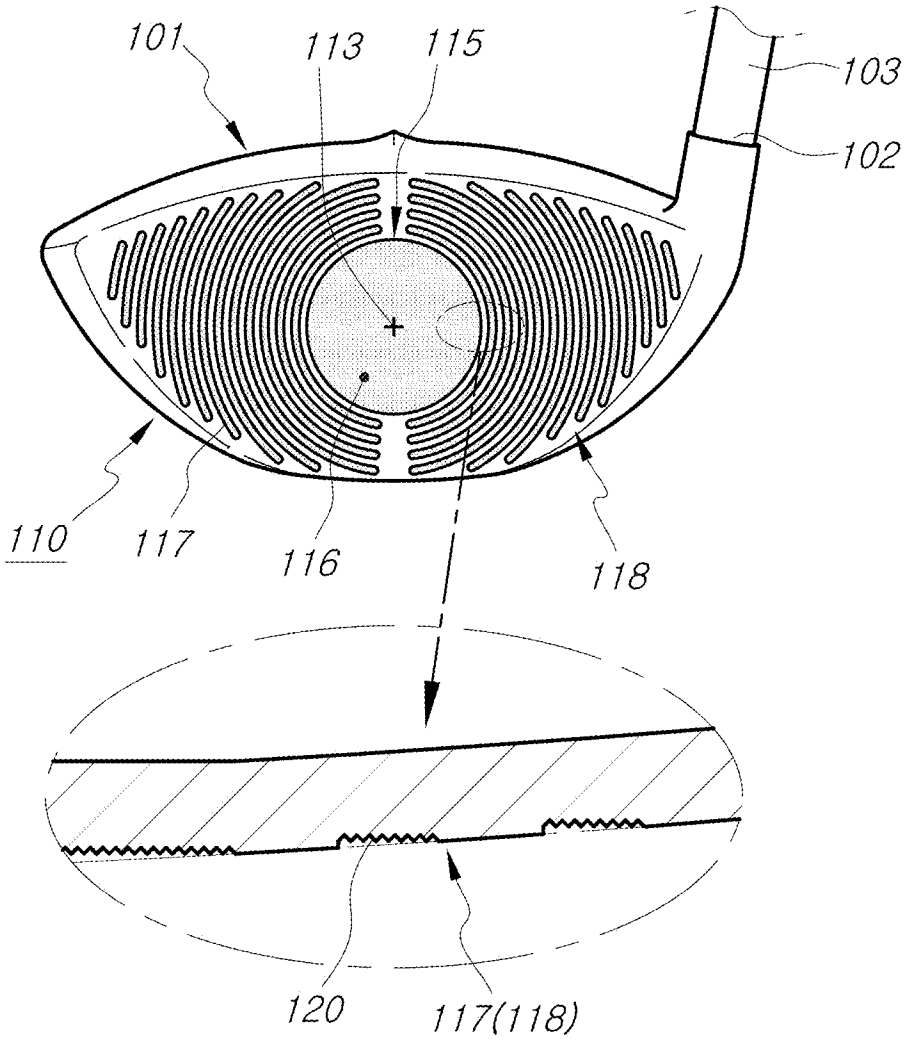
FIG. 6 is a front view and an enlarged view partially illustrating a face of a golf driver according to another example to which the technology of the present disclosure is applied.
Figure 7:
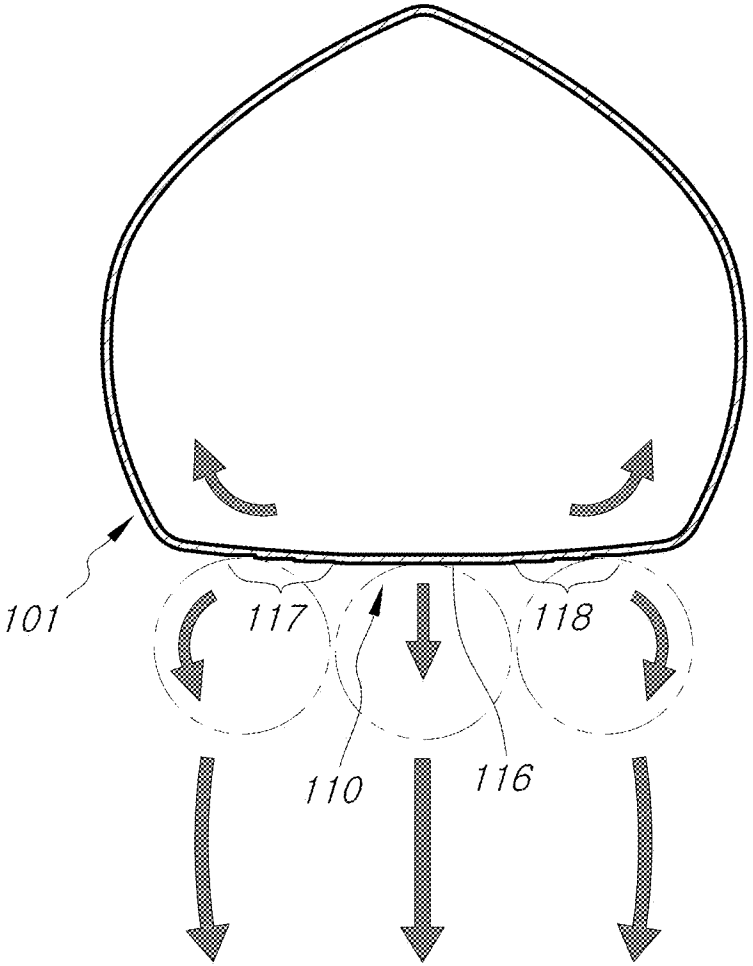
FIG. 7 is a view illustrating a gear effect when a ball is hit against the face of a golf driver to which the technology of the present disclosure is applied.

FIG. 1 is an overall perspective view illustrating a golf driver club for description of the present disclosure, FIG. 2 is a perspective view partially illustrating a face of a golf driver to which the technology of the present disclosure is applied, FIG. 3 is a cross-sectional view partially illustrating a face of a golf driver to which the technology of the present disclosure is applied, FIG. 4 is a front view and an enlarged view partially illustrating a face of a golf driver to which the technology of the present disclosure is applied, FIG. 5 is a cross-sectional view partially illustrating a bulge of a face of a golf driver to which the technology of the present disclosure is applied, FIG. 6 is a front view and an enlarged view partially illustrating a face of a golf driver according to another example to which the technology of the present disclosure is applied, and FIG. 7 is a view illustrating a gear effect when a ball is hit against the face of a golf driver to which the technology of the present disclosure is applied.

A typical golf driver 100 is configured to include a head 101 that substantially strikes a ball, a shaft 103 having a tip end 102 coupled to the head 101, and a grip 105 coupled to a butt end 104 of the shaft 103 and enabling a player to hold and swing a club.

The head 101 is configured to include a head body 108 obtained by connecting a flat sole 106 formed on the bottom surface with a round crown 107 on the upper surface thereof, and a face 110 connected to the front of the head body 108 and actually strikes a ball.

The face 110 has a roll formed in a round shape from the top to the bottom and a bulge formed in a round shape to the left and right sides, and the center position of the roll and the bulge is a sweet spot point 113, and a specific portion around the sweet spot point 113 is referred to as a "sweet spot area" 115.

In the present disclosure, a sweet spot plane 116 is formed by flattening the sweet spot area 115 of the face 110, and toe planes 117 and heel planes 118 are also formed on the toe and the heel on the left and right sides of the sweet spot area 115. Thus, when the sweet spot plane 116 strikes a ball, the ball flies correctly, and when the ball is hit on the toe planes 117 and the heel planes 118, clear compensation is able to be performed due to the gear effect.

The spacing between the toe planes 117 and the spacing between the heel planes 118 are determined while maintaining the lines of the roll and the bulge. In this case, the spacing between the toe planes 117 and the spacing between the heel planes 118 may be determined to be large such that the number of toe planes 117 and heel planes 118 are reduced, or the spacing between the toe planes 117 and the spacing between the heel planes 118 may be determined to be small such that the number of toe planes 117 and heel planes 118 are increased so that the bulge line is formed in a stairway shape, thereby providing various configurations.

As another example, in the case of the roll line, since there are only small remaining areas on the upper and lower sides of the sweet spot plane 116, it is desirable to form planes only on both sides of the sweet spot plane 116 along the bulge line, instead of forming planes on the upper and lower sides of the sweet spot plane 116.

The sweet spot plane 116, the toe plane 117, and the heel plane 118 may further have a friction means 120 formed on the surfaces thereof in order to facilitate compensation for the ball to be directed toward the target through the gear effect in which the ball and the surfaces of the face 110 engage with each other while preventing the ball from slipping when striking the ball, and improving the frictional contact with the ball.

If the friction means is formed to have a visually recognizable size, it may affect the thickness of the face 110 and the like, and may damage the surface of the ball when the ball is hit. Therefore, the friction means may be formed to be fine in consideration of the above problem, and may be formed in any of various forms, such as a knurled form, an uneven form, or the like, but is not limited to a specific form.

The operation and effect of the face for a golf driver, to which the technology of the present disclosure is applied as described above, will be described as follows.

As is well known, the driver 100 is used by a golfer who takes a swing to hit the ball through a series of procedures such as holding a grip, addressing the ball in the tee box, backswing, backswing top, lagging, impacting, and follow-through.

In this process, if the sweet spot area 115 of the face 110 strikes the ball, the ball is able to fly away in a correct direction without any resistance. In the present disclosure, since the sweet spot plane 116 is configured by flattening the sweet spot area 115, if the ball is hit within the sweet spot area 115 based on the sweet spot point 113, it is possible to send the ball more correctly and farther away due to the flatness thereof.

In addition, since the toe planes 117 and the heel planes 118 are further formed on both sides of the sweet spot plane 116, even if the ball is not hit exactly on the sweet spot area 115, the toe planes 117 and the heel planes 118 formed in multiple stages on both sides of the sweet spot area 115 along the bulge line may come into contact with the ball to bring about a gear effect, thereby compensating for the ball to be directed toward the center, and then significantly reducing the phenomenon in which the ball is directed to the penalty area out of the fairway and the rough area.

In particular, since the friction means 120 is further provided to the surfaces of the sweet spot plane 116, and the toe planes 117 and the heel planes 118, which are on both sides of the sweet spot plane 116, the ball may be prevented from slipping, and may cause friction therebetween while the ball is hit on the sweet spot planes 116, the toe planes 117, or the heel planes 118, thereby sending the ball correctly and far. In addition, the ball hit on the toe planes 117 and the sweet spot plane 116 may be sufficiently compensated for due to the clear gear effect, and may be directed to the center.

As a result, the obsession in which golfers must accurately strike the ball against the sweet spot point 113 will be removed, so it is possible to use the driver more softly and smoothly. Further, even if the ball is hit on the toe plane 117 and the heel plane 118 provided in the face 110, rather than the sweet spot area 115, the gear effect in which the ball is directed to the target may be obtained through compensation.

In this way, since the golfer is able to maintain psychological stability, it is possible to perform the softer and more stable swing, thereby lowering the frequency of hitting the ball to the penalty area regardless of a golfer's swing stance and trajectory thereof, which leads to securing of psychological stability, a good influence on a shot using another club, and obtaining a good score.

Although the description of the present disclosure mainly relates to the application to the face of the driver, the present disclosure may also be applied to the face of a utility club as well as a fairway wood in the same manner.

The present disclosure described above has advantages of increasing the probability of hitting the ball on the sweet spot area regardless of the golfer's swing stance and trajectory thereof by the sweet spot plane formed in the center of the head face of the driver and the toe and heel planes formed on both sides thereof, improving straightness and driving distance, and compensating for the ball to be directed to the center through the clear gear effect even if the ball is hit on the heel and toe areas, thereby preventing terrible hooks and slices.

What is claimed is:

1. A face for a golf driver, comprising: a sweet spot point that is a center position of a roll, which is formed in a round shape from the top to the bottom in the front of a head body constituting a head of the golf driver, and a bulge, which is formed in a round shape to the left and right sides thereof, for hitting a ball, and a sweet spot area, which is a specific portion around the sweet spot point, the face comprising:

a sweet spot plane obtained by flattening the sweet spot area of the face; and toe planes and heel planes maintaining roll and bulge lines and formed in multiple stages in toe and heel areas on the left and right sides of the sweet spot area.

2. The face for the golf driver of claim 1, further comprising a friction means formed on surfaces of the sweet spot plane, the toe planes, and the heel planes and configured to increase frictional contact when hitting the ball to prevent the ball from slipping and effectively perform compensation for the ball to be directed toward a target through a gear effect.

* * * * *